United States Patent [19]

Kankaanpaa

[11] 4,202,113

[45] May 13, 1980

[54] PAPER MACHINE DRYING SECTION AND METHOD FOR OPERATING SAME

[75] Inventor: Matti Kankaanpaa, Espoo, Finland

[73] Assignee: Valmet Oy, Finland

[21] Appl. No.: 892,961

[22] Filed: Apr. 3, 1978

[30] Foreign Application Priority Data

Apr. 4, 1977 [FI] Finland ..... 771056

[51] Int. Cl.[2] ..... F26B 3/24

[52] U.S. Cl. ..... 34/23; 34/41; 34/114; 34/116; 162/207; 165/90

[58] Field of Search ..... 34/23, 33, 41, 115, 34/114, 85, 116, 119; 165/89, 90; 162/206, 207, 290, 359

[56] References Cited

U.S. PATENT DOCUMENTS

| | | | |
|---|---|---|---|
| 2,224,803 | 12/1940 | Standley | 34/115 |
| 3,555,700 | 1/1971 | Wagner | 34/116 |
| 3,816,941 | 6/1974 | Holik et al. | 34/116 |
| 3,913,240 | 10/1975 | Flämig | 34/114 |
| 3,956,832 | 5/1976 | Justus | 34/116 |
| 4,000,035 | 12/1976 | Schiel et al. | 34/116 |
| 4,033,049 | 7/1977 | Schiel et al. | 34/115 |
| 4,103,434 | 8/1978 | Walker | 34/114 |

*Primary Examiner*—Larry I. Schwartz
*Attorney, Agent, or Firm*—Steinberg and Blake

[57] ABSTRACT

A paper machine drying section and method for operating the same are provided for reliably maintaining a web in engagement with a drying fabric at locations where the fabric is situated between the web and drying cylinders. Those drying cylinders which are directly contacted by the drying fabric, so that the web is separated therefrom by the drying fabric, are formed with recessed outer surfaces having voids across which the fabric extends. The pressure in these voids is maintained at a magnitude less than the pressure at the outer surface of the web where it travels around those cylinders from which it is separated by the fabric, so that in this way the web is urged by the pressure differential toward the fabric so as to be incapable of becoming detached therefrom. For this purpose either a vacuum system provides in the voids referred to above a pressure less than atmospheric pressure, or at the outer surface of the web there is provided by a suitable pressure chamber a pressure greater than atmospheric pressure, or both of these expedients may be used simultaneously, so that in this way a reliable maintenance of the web in engagement with the drying fabric is achieved where the web is separated from the drying cylinders by the fabric.

16 Claims, 6 Drawing Figures

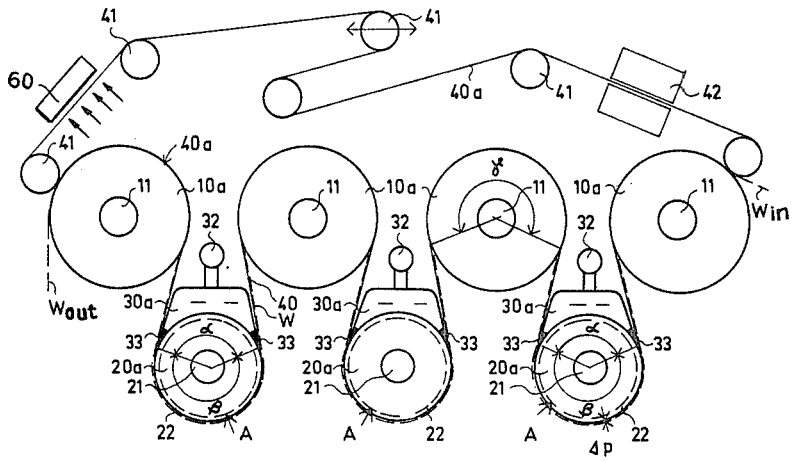
FIG. 1
FIG. 3
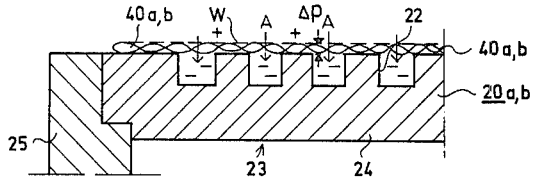
FIG. 4A
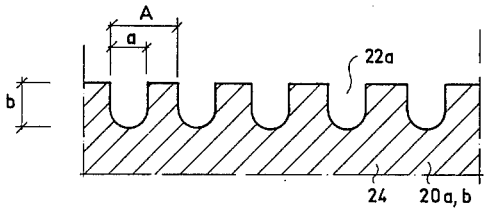
FIG. 4B
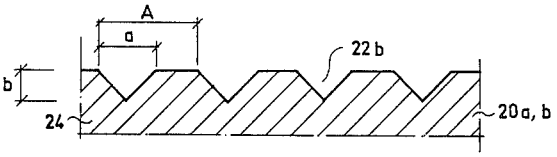
FIG 5
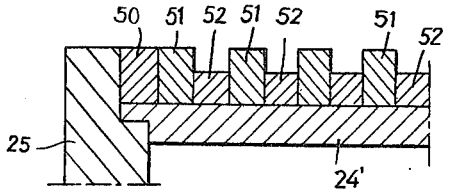

PAPER MACHINE DRYING SECTION AND METHOD FOR OPERATING SAME

BACKGROUND OF THE INVENTION

The present invention relates to paper machines and methods of operating the same.

In particular, the present invention relates to the drying section of a paper machine and to a method for operating the same.

The present invention relates especially to the initial part of the drying section which includes at least one group of drying cylinders, a fabric loop formed from a suitable drying fabric means or felt being guided around these cylinders which are arranged in two main rows in such a way that the cylinders of one row are situated in alignment with spaces between the cylinders of the other row. The fabric means travels in zig-zag fashion around the above group of cylinders in a manner situating one row of cylinders within the loop of the fabric means and the other row of cylinders outside of this loop. The arrangement is such that the web is at all times supported by the fabric while travelling therewith around the above rows of drying cylinders so that there is no open draw for the web within said group of cylinders.

Thus, the present invention relates to a drying section which has two main rows of drying cylinders arranged horizontally with one row situated at an elevation higher than the other and with the cylinders of one row situated in alignment with the spaces between the cylinders of the other row, a drying fabric means in the form of a suitable drying wire or felt being guided in zig-zag fashion around the cylinders to situate one cylinder row within the loop of the fabric means and the other outside of this loop, at least those cylinders which are situated outside of the loop being smooth-surfaced cylinders which are heated in a suitable manner and which are directly contacted by the web over a given sector of the latter cylinders.

As is shown, the drying section of the paper machine usually includes two main rows of smooth-surfaced drying cylinders which are arranged horizontally and located with one row above the other. The paper web is conducted so as to travel in zig-zag fashion around the drying cylinders so that the web alternately travels around the cylinders of the upper and lower rows while directly contacting all of these cylinders. The web is pressed against the surfaces of the cylinders over a given sector thereof by utilizing so-called drying felts or drying fabrics of which at least one is provided for the cylinders of the upper row and at least one is provided for the cylinders of the lower row. The fabric means referred to in this application is intended to apply to all fabrics, whether wires or felts, which are appropriate for this purpose, regardless of their material and manner of manufacture.

With such an arrangement the web is not supported at all times. Instead there is an open draw while the web travels from the cylinder of one row to the cylinder of another row. Thus, the web is in such an event exposed in the space between the cylinder rows to those air currents which are created by the rotating cylinders. As a consequence, there occurs in many cases a powerful fluttering of the web, to such an extent that the web may break and cause a shut down in the production. Attempts have been made to eliminate this drawback by arranging at the initial part of the drying section, said free or open draws to be shorter than is the optimum length of said draws as regards the drying process. In this connection reference may be made to Finnish Pat. No. 45,585.

In order to improve the reliable operation of a paper machine, it has been also proposed to provide an arrangement, which has already been tried, wherein the web is conducted at the initial part of the drying section, for example within the first cylinder group, in such a way as to be supported by a fabric means at all times. In this case this particular cylinder group has only a single fabric means which is common to the cylinders of both the upper row and the lower row. Thus with such an arrangement the fabric means presses the web against the surfaces of the cylinders of one row, for example, the upper row, while at the lower row the fabric means is situated between the web and the cylinders of this lower row.

With an arrangement of this latter type it is possible to achieve a remarkable improvement in the reliability of the operation of the paper machine. However, this improvement is achieved at the expense of the desired drying effect, inasmuch as at the lower row of cylinders, in the above example, the web is not directly in contact with the drying cylinders but is separated therefrom by the fabric means. Thus the improvement of reliability in operation achieved by such an arrangement is based on the fact that the fluttering of the web is prevented at the space between the upper and lower rows. However, it has been found that in connection with paper machines which operate at high speeds the web tends to detach itself from the fabric means while travelling around these cylinders, as a result of centrifugal force or also due to the weight of the web at the lower cylinder row. This centrifugal force increases with increasing speed and with a decreasing diameter of the drying cylinders. The detachment of the web from the fabric means is partly due to the fact that in the throat between the fabric means and the surface of the cylinder there is generated a relatively high pressure which tends to detach the web from the fabric means.

The present invention relates to a method and apparatus according to which the web is transported in closed conduction, without any open draw, at least at the initial part of the drying section.

With respect to the state of the prior art which may pertain to the present invention, reference may be made to U.S. Pat. Nos. 3,503,139 and 3,874,997.

U.S. Pat. Nos. 3,503,139 shows a construction according to which a drying cylinder group, as is conventional, has two rows of cylinders situated one above the other and having smooth surfaces while being provided only with a single lower drying wire. The paper web passes through this cylinder group in such a way that the drying wire presses the web directly against the surfaces of the lower cylinders whereas at the upper row the web is sepated from the surfaces of these upper drying cylinders by the drying fabric. In order to attempt to compensate for the impairment in drying efficiency resulting from the above arrangement, at the cylinders of the upper row, these cylinders of the upper row are operated at a temperature higher than those at the lower row. The result is that the steam system of the paper machine is more complex than usual. It hss also been attempted to improve the drying effect by providing for the cylinders of the upper row a housing which may contain a means for providing for the blowing of hot air against the surface of the web.

Thus, the purpose of the above patent is simply to improve and enhance, by way of heat technology, the drying process while at the same time attempting to achieve a paper of higher quality. The disclosure of this patent is not directed toward improving the reliability of the operation of the paper machine.

With respect to U.S. Pat. No. 3,874,997, there is a construction according to which the cylinder group has also a pair of horizontal rows of drying cylinders through which the web travels while being supported by one drying wire only. The cylinders in the lower row have a smooth surface and insofar as these cylinders are concerned the drying of the web is carried out by contact drying. The cylinders of the upper row, however, are permeable to air, and with respect to these upper cylinders the drying is in part carried out by flow of air through the cylinder shells and in part by impingement of air on the web, for which purpose there is provided in this patent a structure enclosing the upper row of cylinders in a hood which blows hot air. Thus this patent also relates primarily to an improvement in the drying process, with respect to the heat technology thereof.

SUMMARY OF THE INVENTION

It is accordingly a primary object of the present invention to provide a method and apparatus which will avoid the above drawbacks.

Thus, it is an object of the present invention to provide a method and apparatus where the web is supported at all times by a single fabric means while travelling at least through a first drying cylinder group, so that the drawbacks referred to above are avoided.

A primary object of the present invention is therefore to improve the reliability in the operation of the paper machine by assuring that the web will remain at all times contiguous to the drying fabric means particularly at the location where the web is situated at the outer surface of the fabric means while the latter laps a drying cylinder.

In addition it is an object of the present invention to provide a method and apparatus according to which the web will not be subjected to excessive tension while travelling through the drying group so that the finished paper will have improved stretch and strength characteristics.

Futhermore it is an object of the present invention to provide a method and apparatus according to which the evaporation from the web has in a simple way been enhanced on those cylinders where the web is separated from the cylinder surface by the fabric means.

In order to achieve the above objects the method of the invention is primarily characterized in that at least at one part of the cylinders which are situated in a row where the web is at the outside of the drying fabric, the web is subjected by way of using recessed cylinder surfaces to a differential pressure so that the pressure at the outer surface of the web is greater than the pressure within the voids of the recessed cylinder surfaces, the purpose of these procedures being above all to prevent detachment of the web from the fabric means and to assure the continuous operation of the paper machine.

With the structure of the invention the cylinders of that row which is situated within the loop of the fabric means are provided at least in part with recessed surfaces while with respect to the latter cylinders means have been provided for achieving a differential pressure between the outer surface of the web and the cylinder voids opposite the web.

These recessed surfaces may consist most advantageously of a system of grooves formed at the surface of the cylinder, and in the description which follows such an embodiment has primarily been provided.

It is thus to be understood that the primary concept of the invention is that at least part of those drying cylinders which are directly contacted by the fabric means so that the latter separates the web therefrom have a grooved surface while these cylinders and in particular the grooves thereof are connected to a suction system which maintains a vacuum in the area where the particular cylinder is covered by the web and the fabric means.

With such an arrangement the web will be held tightly contiguous to the fabric means and with the structure of the invention the penetration of air along with the fabric means between the web and the cylinder is avoided. Furthermore, it is to be noted that the grooving of the exterior surface of the cylinder places a considerable volume of voids under vacuum. This achieves a remarkable improvement in the evaporation of water from the web. Evaporation is exceedingly more efficient in vacuum than at normal pressure. The grooving also achieves an increased heating surface and enhances heat transfer from the cylinder.

It is possible to apply the invention advantageously by utilizing instead of a conventional plastic drying wire a metallic fabric or wire. It is possible to heat such a metallic wire to a relatively high temperature so that considerable quantities of heat can be introduced into the web for further improvement of evaporation from the web.

The groove and cylinders of the invention have solid shells and can be connected in a normal manner to the steam system of the drying section.

The grooving of the exterior surface of the cylinders can be carried out either by machining or by covering the cylinder surface with one or more metal strips having a special profile, as shown, for example, in Finnish Pat. No. 45,583. The cross section of the grooves may be rectangular, triangular, semicircular, etc. The semiconductor configuration is particularly favorable with a view to self-cleaning as well as other cleaning procedures for the grooves.

The use of a relatively stiff metallic fabric as a drying fabric means allows fairly wide grooves to be provided in the drying cylinders without risk of introducing markings of the grooves onto the web. The structure of a plastic wire also may possess a certain desirable rigidity in a transverse direction.

By way of the circumstance that the web is maintained contiguous to the fabric means by utilizing a vacuum, a further advantage is achieved in that it is not necessary to subject the web to a high tension, which would be necessary in the event that the web is maintained in contact with the fabric means only by way of tension of the web. Since the web is not under excessive tension and thus is not stretched during this particular stage in the operation, it is possible in this way to achieve better stretch and strength characteristics in the finished paper.

BRIEF DESCRIPTION OF DRAWINGS

The invention is illustrated by way of example in the accompanying drawings which form part of this application and in which:

FIG. 1 is a schematic elevation of one possible embodiment of a method and apparatus of the invention;

FIG. 3 is a fragmentary sectional elevation showing the structure of a cylinder of FIGS. 1 and 2;

FIG. 4A is a fragmentary sectional elevation showing another possible embodiment of a cylinder structure;

FIG. 4B shows yet another embodiment of a cylinder structure; and

FIG. 5 is a fragmentary sectional elevation of a further embodiment of a cylinder which may be utilized in FIGS. 1 and 2.

DESCRIPTION OF PREFERRED EMBODIMENTS

Figure 2:
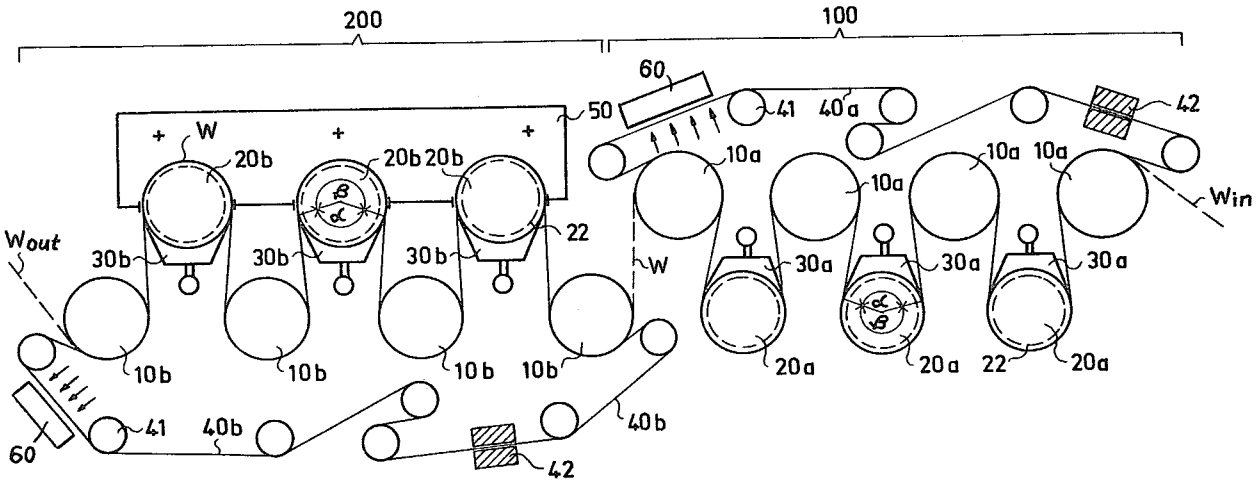
FIG. 2 is a schematic elevation of another possible embodiment of a method and apparatus of the invention.

It is to be understood in the following that a cylinder group refers to those cylinders which have a single fabric loop, in the form of a suitable drying felt or drying fabric, in common. These cylinders may, at the same time constitute a group of their own in the steam supply system, but they may as well be part of a more comprehensive steam system. Moreover, the cylinders of one cylinder group need not be heated in an identical manner in that part of the cylinders may be steam-heated and part of them may be electrically heated, for example. Similarly, the cylinder group may be driven independently or its drive may be effected within a larger drive system.

Referring to FIG. 1, there is illustrated therein a first drying cylinder group of a dryer part of a paper machine. This drying cylinder group includes a row of upper cylinders 10*a* and a row of lower cylinders 20*a*. The cylinders 10*a* as well as the cylinders 20*a* are heated by steam, and FIG. 1 schematically illustrates steam couplings 11 and 21, respectively provided for the upper and lower cylinders. However it is to be understood that these connections 11 and 21 also may be considered as depicting electrical heating means in a schematic manner. The group of cylinders of FIG. 1 is provided with a single fabric means 40*a* in such a way that the cylinders 20*a* of the lower row are situated within the loop of the fabric means, thus forming an inside row of cylinders, while the upper cylinders 10*a* are situated outside of the loop, thus forming an outer row of cylinders.

The web W is shown threaded between the right cylinder 10*a* and the fabric means 40*a* at the location $W_{in}$, the web W travelling to this location from the press section of the paper machine, utilizing the structures known in the art for this purpose. The web W passes through the group of drying cylinders in closed conduction, which is to say supported at all times by the fabric 40*a*, so that there are no open draws. At the upper row of cylinders the web directly contacts the heated surfaces thereof. The web W laps each of the upper cylinders 10*a* through the angle $\gamma$ which is preferably greater than 180°. At the lower inner row of cylinders 20*a* the web is situated outside of the fabric means 40*a*, so that in this case the fabric means 40*a* is interposed between the web and the heated surfaces of the cylinders 20*a*.

In the example of FIG. 1 the lower cylinders 20*a* may be considered as being heated by steam, in the same way as the upper cylinders 10*a*. The cylinders 20*a* differ, however, from standard drying cylinders, above all in that their surfaces are recessed, being formed with grooves as illustrated, for example, in FIG. 3. The grooving 22 forming the recesses at the outer surface of each of the cylinders 20*a* may be provided in any manner which is known in itself, for example by machining the shell so that it has an inner solid portion or advantageously, by providing the solid shell body with a covering made of a profiled strip by winding, as shown in FIG. 5 and described below.

Because of the grooving 22, the construction and manufacturing of the cylinders 20*a* may differ considerably from those of conventional cylinders. In view of cost, these grooved cylinders 20*a* may have a smaller diameter than the upper cylinders 10*a*, as is apparent from FIG. 1. The difference in diameter is not essential in principle. The drying efficiency of the lower cylinders 20*a* in an arrangement of this type is as a rule inferior to that of tne contact drying cylinders 10*a*, and it is not always possible economically to compensate for this by increasing the diameter. The small diameter of the grooved cylinders affords the advantage that with a standard cylinder spacing the sector $\beta$ will be small and, as a result, the quantity of air that must be drawn through the web W at this location is small. The length of the grooves 22 will also be shorter with cylinders of smaller diameter, and this also contributes to a reduction in the suction capacity required. It is possible, however, to find an optimum ratio for the diameters of the upper and lower cylinders.

The grooving 22 may be in the form of a single helical groove extending continuously from one to the other end of the cylinder, or there may be a multiplicity of circumferential grooves spaced from each other by ribs.

Thus, the fabric means 40*a* and the web W engaging its surface lap each of the lower cylinders 20*a* through the angle $\beta$. At the sector $\alpha$ remaining outside this sector $\beta$, a gas pressure regulating means is provided, this latter means taking in the illustrated example the form of vacuum chambers 30*a* which are respectively in alignment with the spaces between the cylinders of the upper row. Each of the vacuum chambers 30*a* defines an interior vacuum space which is at less than atmospheric pressure, each chamber communicating through a pipe 32 with a source of vacuum which in itself is known. The chambers 30*a* have closed ends and end margin seals (not shown) situated against the surface of the cylinders 20*a*, so that a fluid-tight sliding contact is provided between the vacuum chambers 30*a* and the rotating cylinders 20*a*. FIG. 1 schematically illustrates sealing members 33 situated at the margins of the chambers 30*a* in contact with the cylinders 20*a* as well as with the fabric means 40*a*. These sealing members 33 may be made of a material which is resistant to wear such as, for example, a suitable ceramic substance. The fabric means 40*a* is illustrated as being guided by the guide rolls 41.

In the interior space of each vacuum chamber 30*a* there is a reduced pressure providing a suction which acts through the grooving 22 at the sector $\beta$ of each cylinder 20*a*. As a result of this suction effect, the web W is held against and will not detach itself from the fabric means 40*a* at the section $\beta$ of each cylinder 20*a*. Moreover, there is generated a slight flow A of air through the fabric 40*a* and the web W, this through-flow of air promoting the drying of and evaporation from the web and also being conducive to maintaining the web W against the fabric 40*a*. The evaporation of water from the web is also enhanced by the fact that the web W is subjected to vacuum at the sector $\beta$.

Referring to FIG. 2, there is also shown an arrangement according to the invention, this embodiment including a pair of consecutive cylinder groups 100 and 200 in the illustrated drying section. In the first group 100 are lower cylinders 20*a* grooved as described above, while in the second group 200 the upper cylinders 20*b* are grooved cylinders. With this arrangement the result is obtained that both sides of the web W, consecutively, are subjected to contact drying, which is to say both at the lower side and the upper side of the web. Such an arrangement may be useful in the case of relatively thick webs. It is essential that specifically in the first group 100 cylinders 20*a* are at the lower row where the web W lies at the outside of the drying wire. This arrangement is advantageous for the reason that the lead strip used for threading the web W at the starting-up phase and the web wastes produced during this operation, which are particularly copious in the first group, can easily be removed to the space below this group.

As is indicated in FIG. 2, the gas pressure regulating means in addition to and including the vacuum chambers 30*a*,30*b* includes a pressure chamber 50 defining in its interior a space supplied with air at greater than atmospheric pressure, and the web W communicates with the interior space of the pressure chamber 50. This chamber 50 may have a construction similar to that disclosed in U.S. Pat. No. 3,874,997. Thus in this case a pressure differential will be provided at the upper inside rolls 20*b* by creating at the outside of the web a pressure greater than atmospheric pressure. In addition, however, it will be seen that there are vacuum chambers 30*b* which cooperate with the cylinders 20*b* in the same way that the chambers 30*a* cooperate with the cylinders 20*a*. It is to be understood that an over-pressure chamber 50 is by no means indispensable to the invention.

The fabric means 40*a* and 40*b* respectively utilized in the groups 100 and 200 may be conventional drying fabrics or felts.

One advantageous embodiment of the invention is to use metallic fabric means. Such a metallic wire 40*a* can be heated to an exceedingly high temperature by way of a suitable heating means 42.

In this way, in some cases, considerable quantities of heat may be introduced into the web for improving the evaporation. Taking into consideration this additional heat, on the one hand, and on the other hand, the enhancement of evaporation achieved by way of the vacuum in the grooves of the cylinders, it is to be observed that although the web is situated at the outside of the fabric means at the sectors $\beta$, nevertheless the drying effect may be as good as that in a conventional multiple cylinder dryer where the web W lies directly next to the cylinder surface at the lower as well as the upper cylinders.

Referring to FIG. 3 it will be seen that the cylinders 20*a*, 20*b* have a shell 23 with an inner solid portion 24 and an end wall 25 which is fragmentarily illustrated, the grooving 22 either being separate circumferential grooves or at least one continuous helical groove as pointed out above. FIG. 3 illustrates how either of the fabric means 40*a*, 40*b* cooperates with the cylinders bridging the voids formed in the outer surfaces thereof, the through-flow A being indicated as well as the differential pressure which is of course greater at the outer surface of the web W urging the latter against the fabric means. In the example of FIG. 3, the grooves 22 are of a rectangular cross section.

In FIG. 4A there is shown a cylinder shell which also has an inner solid portion 24 which is not perforated. In this case, the grooves 22*a* have the depth b and the width a while being spaced one from the next by the distance A. The same dimensions are illustrated for the triangular grooves 22*b* of the embodiment of 4B, the grooves 22*a* of FIG. 4A having bottom portions which are semicircular in cross section.

The narrower the mouths of the grooves, the larger the area of the heat-conducting surface directly contacting the fabric means. On the other hand, the greater the width a of the grooves, at their mouth, the greater the uniformity of the effect of the differential pressure action on the web in the sector $\beta$. The grooves may have either the triangular cross section shown for the grooves 22*b*, or the rectangular or partly semicircular cross sections shown respectively in FIGS. 3 and 4A, although any other suitable geometric configuration for the cross section of the grooves may be provided.

In addition an arrangement as shown in FIG. 5 may be provided where each cylinder 20*a* or 20*b* also has a pair of opposed end walls 25 but in this case carries an inner shell 24' having wound thereon the strips 51, 52 which are situated next to the end ring 50 in FIG. 5. These strips 51 and 52 may be simultaneously wound onto the cylinder body 24' so as to form continuous helically wound strips, although separate rings may also be used if desired. In any event, it will be seen that the depth of the strip 51 is greater than that of the strip 52 so that in this way the strips of FIG. 5 provide the exterior spaces or grooving for this particular embodiment. Of course instead of separate strips it is possible to use a single strip having the cross section of the combined strips 51 and 52 and wound in a known way onto the cylinder body. Thus it is possible to provide for the recessed surface of the cylinders 20*a* and 20*b* a wide variety of configurations at the spaces which in the illustrated example take the form of the grooves.

It is to be noted that a semicircular configuration at the groove bottoms as shown in FIG. 4A is easy to produce by machining, and in addition such grooves are easy to clean and may even be self-cleaning. The rectangular grooves 22 of FIG. 3 may of course easily be produced by the strip-winding procedure as illustrated in FIG. 5, but such grooves do have the drawback that dust and fiber accumulations tend to form at the corners of the grooves.

It is in addition advantageous if in connection with the fabric means 40*a*, 40*b*, a means 60 is provided for removing dust from the mesh of the fabric means, such undesirable dust being deposited at the fabric means from the web W, for example. In the illustrated example the means 60 takes the form of a vacuum chamber creating a flow of air through the fabrics as indicated by the arrows, although if desired a suitable blower means may be used for this purpose. Such a means for creating a flow of air through the mesh of the fabric means to clean the latter may be situated at the same location as the heating means 42, closely adjacent the latter, or at any desired location such as those illustrated. Thus by way of the means 60 it is possible to maintain the permeability of the fabric.

The invention is applicable to the greatest advantage on the first cylinder group of the drying section or at the initial part of the drying section. After the web W has dried sufficiently and thus has an adequate strength, it may be conducted in a conventional manner having free draws from one cylinder row to the other.

Of course the invention is not to be narrowly confined to the specific embodiments shown in the drawings and described above by way of example only, inasmuch as the details of the invention may vary within the inventive concept defined by the claims which follow.

What is claimed is:

1. In a method for operating a paper machine drying section having drying cylinders arranged in two horizontal main rows, with said drying cylinders including at least one cylinder group equipped with a drying fabric means forming a loop and lapping the drying cylinders of said cylinder group in zig-zag fashion so that the cylinders of one row are outer cylinders situated outside and the cylinders of the other row are inner cylinders situated inside said loop, and for drying a continuous fibrous web travelling together with and supported by said fabric means at said one cylinder group, said fibrous web during its travel along said cylinder group having portions in direct contact with the outer cylinders and portions separated from the inner cylinders by said fabric means, said inner cylinders being formed with outwardly opening voids in their outer surfaces, said outer surfaces being non-perforated, the step of creating in said voids by suction means applied externally to said inner cylinders a pressure lower than the pressure at the outer surface of the portions of said web travelling along said inner cylinders while separated therefrom by said fabric means, thus providing a pressure differential urging said web against said drying fabric means at said inner cylinders to prevent detachment of said web from said drying fabric means.

2. In a method as recited in claim 1 and including the step of providing at the outer surface of said web where the latter travels along said inner cylinders a pressure greater than atmospheric pressure for maintaining the web in engagement with said fabric means while travelling along said inner cylinders.

3. In a method as recited in claim 1 and including the step of heating all of said drying cylinders.

4. In a method as recited in claim 1 and including the step of heating said fabric means at a location remote from said cylinders to elevate the temperature thereof for promoting evaporation of water from the web.

5. In a paper machine, a drying section comprising two horizontal main rows of drying cylinders forming at least one cylinder group and arranged with the cylinders of one row aligned with the spaces between the cylinders of the other row, single fabric means forming a closed loop at said group of cylinders and extending in zig-zag fashion around the cylinders in said group with cylinders of one row being outer cylinders situated outside said loop and having smooth surfaces while cylinders of the other row are inner cylinders situated inside said loop, so that a fibrous web travelling with said fabric means through said cylinder group will be in direct contact with the smooth surfaces of the outer cylinders, while at said inner cylinders said fabric means will be situated between said web and the inner cylinders preventing direct contact between said web and inner cylinders, said inner cylinders being formed at their outer surfaces with outwardly opening voids across which said fabric means extends, said outer surfaces being non-perforated, and gas pressure regulating means external of said inner cylinders cooperating with said inner cylinders over their surface portions which are not lapped by said fabric means for creating in said voids a pressure less than the pressure at the outer surfaces of said web where it travels around said inner cylinders for providing a pressure differential urging said web toward said fabric means at said inner cylinders and preventing detachment of said web from said fabric means while travelling around said inner cylinders.

6. The combination of claim 5 and wherein a means cooperates with said fabric means at a location remote from said cylinders for creating a stream of air which flows through the mesh thereof for maintaining said fabric means clean and freely permeable to flow of gas therethrough.

7. The combination of claim 5 further including means at a location remote from said cylinders for heating the endless fabric means to elevate the temperature thereof for promoting the evaporation of water from the web.

8. The combination of claim 5 and wherein said gas pressure regulating means includes a plurality of vacuum chambers respectively aligned with the spaces between said outer cylinders and covering respectively those inner cylinder portions which are not lapped by said fabric means, said vacuum chambers respectively having a sealed fluid-tight contact with said inner cylinders.

9. The combination of claim 5 and wherein said gas pressure regulating means includes a chamber means enclosing a space in which said web is situated while travelling around said inner cylinders, and said chamber means providing in its interior a pressure greater than atmospheric pressure for urging said web toward said fabric means while travelling around said inner cylinders.

10. The combination of claim 5 and wherein a steam-heating means cooperates with said inner cylinders for heating the latter.

11. The combination of claim 5 and wherein an electrical heating means cooperates with said inner cylinders for heating the latter cylinders.

12. The combination of claim 5 and wherein said inner cylinders are formed at their outer surfaces with grooves which form said voids.

13. The combination of claim 12 and wherein said grooves extend circumferentially around said inner cylinders while each being situated substantially in a plane normal to the axis of each inner cylinder.

14. The combination of claim 5 and wherein each of said inner cylinders has a solid shell and said voids extending only partly into said shell so that said shell has an inner non-perforated portion.

15. The combination of claim 14 and wherein said shell of each of said inner cylinders is in the form of a one-piece body.

16. The combination of claim 14 and wherein said shell of each of said inner cylinders includes an inner cylindrical body and outer strip means circumferentially surrounding said body for defining said voids at the outer surface of each of said inner cylinders.

* * * * *